US010143065B2

(12) United States Patent
Potempa et al.

(10) Patent No.: US 10,143,065 B2
(45) Date of Patent: Nov. 27, 2018

(54) DIMMER SWITCH

(71) Applicants: Michael M. Potempa, Freeport, IL (US); Brian S. Potempa, Freeport, IL (US)

(72) Inventors: Michael M. Potempa, Freeport, IL (US); Brian S. Potempa, Freeport, IL (US)

( * ) Notice: Subject to any disclaimer, the term of this patent is extended or adjusted under 35 U.S.C. 154(b) by 0 days.

(21) Appl. No.: 14/706,205

(22) Filed: May 7, 2015

(65) Prior Publication Data

US 2015/0237705 A1 Aug. 20, 2015

Related U.S. Application Data

(63) Continuation of application No. 14/066,472, filed on Oct. 29, 2013, now abandoned, which is a continuation of application No. 11/558,617, filed on Nov. 10, 2006, now abandoned.

(51) Int. Cl.

| | |
|---|---|
| ***H01H 19/00*** | (2006.01) |
| ***H01H 19/58*** | (2006.01) |
| ***H01H 21/00*** | (2006.01) |
| ***H05B 37/02*** | (2006.01) |

(52) U.S. Cl.
CPC ..... *H05B 37/02* (2013.01)

(58) Field of Classification Search
CPC ..... H01H 19/00; H01H 19/58; H01H 21/00; H01H 19/02; H01H 19/10; H01H 19/001; H01H 19/003; H01H 19/04; H01H 19/14; H01H 2003/08; H01H 2003/085; H01H 2003/10; H01H 2009/02; H01H 2221/00; H01H 2221/01; H01H 2221/014; H01H 3/00; H01H 3/12; H01H 13/00; H01H 13/12; H01H 13/14; H01H 13/50; H05B 37/02
USPC ..... 200/14, 297, 293, 5 E, 56 R, 61.02, 308, 200/310, 312–314, 317, 302.1, 333, 5 A; 362/166, 811, 161, 157, 810
See application file for complete search history.

(56) References Cited

U.S. PATENT DOCUMENTS

| | | | | |
|---|---|---|---|---|
| 3,103,618 A * | 9/1963 | Slater | G05F 1/445 | 307/146 |
| 4,649,323 A * | 3/1987 | Pearlman | H02M 5/2576 | 315/292 |
| 7,850,327 B2 * | 12/2010 | Campbell | H05B 37/029 | 362/157 |
| 2007/0176714 A1 * | 8/2007 | Potempa | H01H 3/0213 | 335/1 |

* cited by examiner

*Primary Examiner* — Anthony R. Jimenez

(57) ABSTRACT

A dimmer switch for controlling a light includes a wheel assembly, a rotational motion detector and a dimmer control. As the wheel assembly is rotated, the light is dimmed. An on/off control is responsive to a push detector for detecting whether the wheel assembly has been pushed. The on/off control controls where the light is on or off.

7 Claims, 7 Drawing Sheets

DIMMER SWITCH

RELATED APPLICATIONS

This application is a continuation of application Ser. No. 14/066,472, entitled "Dimmer Switch", filed Oct. 29, 2013, which was a continuation of Ser. No. 11/558,617, entitled "Dimmer Switch", filed Nov. 10, 2006, now abandoned. The contents of the prior applications are hereby incorporated by reference.

This application claims benefit of Provisional Application No. 60/735,631, entitled "Dimmer Switch" and filed Nov. 10, 2005, the contents of which are hereby incorporated by reference.

BACKGROUND OF THE INVENTION

Wall mountable devices for dimming lights are common. Some dimmer switches include an independent on/off control and as well as a slide or switch for varying the intensity of the light from the lamp. Dimming switches are usually mounted in an electrical wallbox and covered by a wall plate.

U.S. Pat. No. 4,939,383 issued to Tucker shows a dimmer switch with a push button on/off switch. A dimmer slide is positioned above the push button on/off switch. In U.S. Pat. No. 5,359,231 to Flowers et al., a dimmer switch includes an on-off switch and a dimmer which could be a slide, a rotor and up/down buttons. The dimmer switch shown in U.S. Pat. No. 5,637,930 includes an electronic touch switch. The planar actuator is located adjacent to a dimmer actuator.

DESCRIPTION OF THE DRAWINGS

Figure 1:
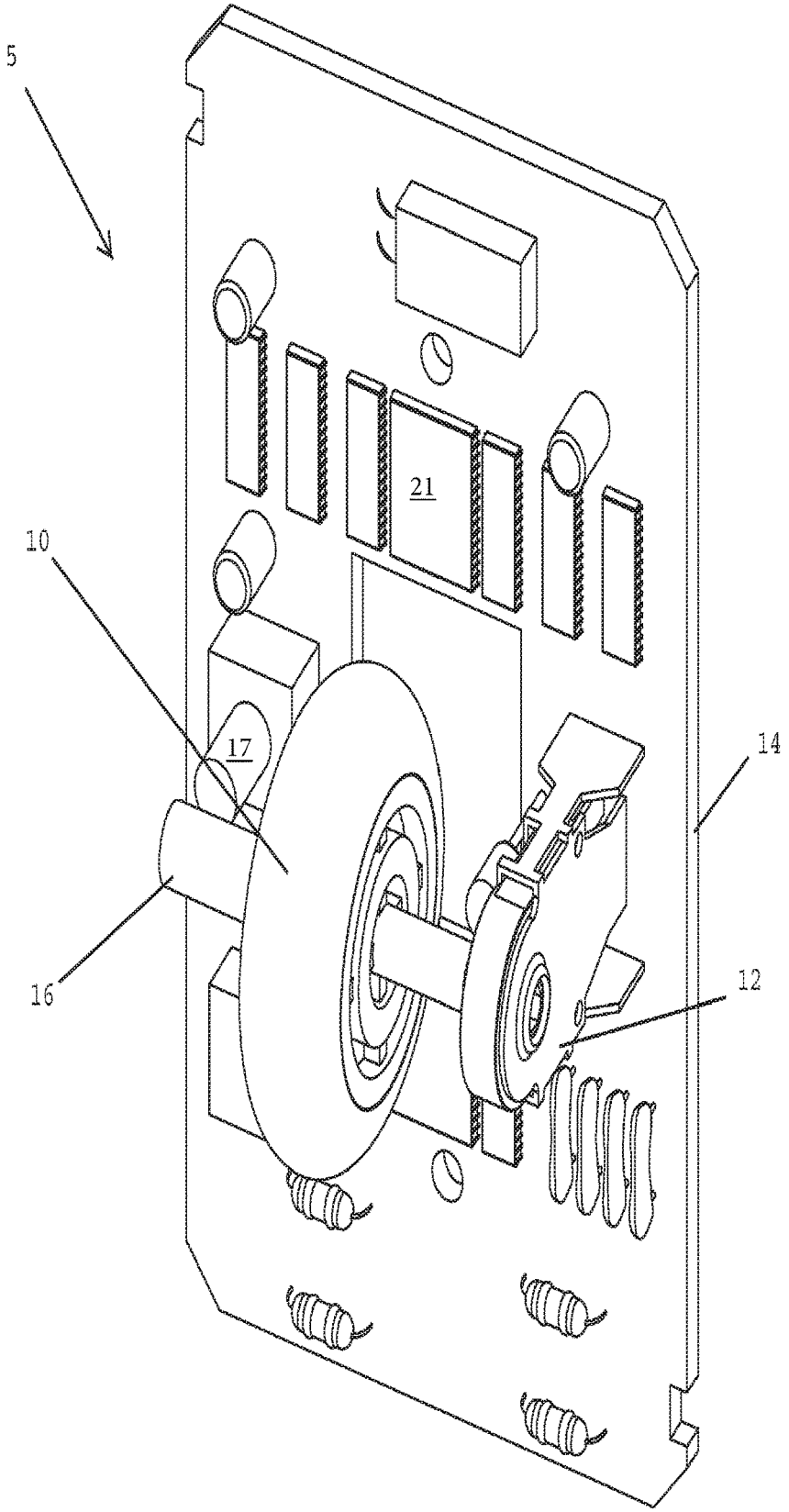
FIG. 1 is an actuator for a dimmer switch.

FIG. 1 shows an actuator for dimmer switch 5. One axis of wheel 10 extends into sensor 12. Wheel 10 could be a scroll wheel, multiple wheels, a barrel, ball, belt or any other cylindrical object. Wheel 10 could be made of elastomers and provided with a tactile grip. 10 Sensor 12 detects the rotation of the axis of wheel 10 or the rotation of the wheel itself. A processor 21_or controller on board 14 reads the output of the sensor. The output of sensor 12 is then used to control the power output of a lighting system controlled by dimmer switch 5. Sensor 12 could be a potentiometer. If sensor 12 were a potentiometer, then rotation of wheel 10 would change the resistance of the potentiometer. Using well known 15 techniques, the resistance of the potentiometer can be used to adjust the power output of the lighting system.

Sensor 12 could also be a device providing pulses. In this system, as wheel 10 is turned, pulses are produced as an output of the sensor. Various well known methods can be used to detect the direction of rotation of the wheel. A processor or controller 21_decrements or increments a variable. The variable is used to control the power output. In such a dimmer switch, it would be possible to allow the wheel to turn without limitation. The dimmer switch could be programmed so that the power output would reach a maximum and maintain that maximum even if the wheel were turned further in a pre-selected direction. Alternatively, the dimmer switch could be programmed to reduce the power after a maximum level was reached if the wheel were turned in either direction.

Similarly, if a minimum were reached, the processor 21 could be programmed so that the power output would remain at the minimum level if the wheel were continually turned in the same direction. Alternatively, the power output could increase after the minimum was reached irrespective of the direction of rotation of the wheel.

Axis 16 is used to actuate a push detector 17. When wheel 10 is pressed, axis 16 pushes push detector 17. If wheel 10 is pressed, then a special operating function is triggered for the dimmer switch 5. For example, pushing wheel 10 could turn the power on or off. Alternatively, pushing wheel 10 could cause the dimmer switch to lock 10 at a particular light level such that further rotation of the wheel would not change the dimming level of the light. Or, pushing wheel 10 could cause the dimmer switch to execute a particular program for varying the light intensity.

Axis 16 is one of several methods for detecting the pushing of wheel 10. Alternatively, the motion of the wheel itself could be detected. The wheel itself could be pushed 15 into a switch. Alternatively, any separate mechanism could be attached to the wheel which then pushes on a switch.

Figure 2:
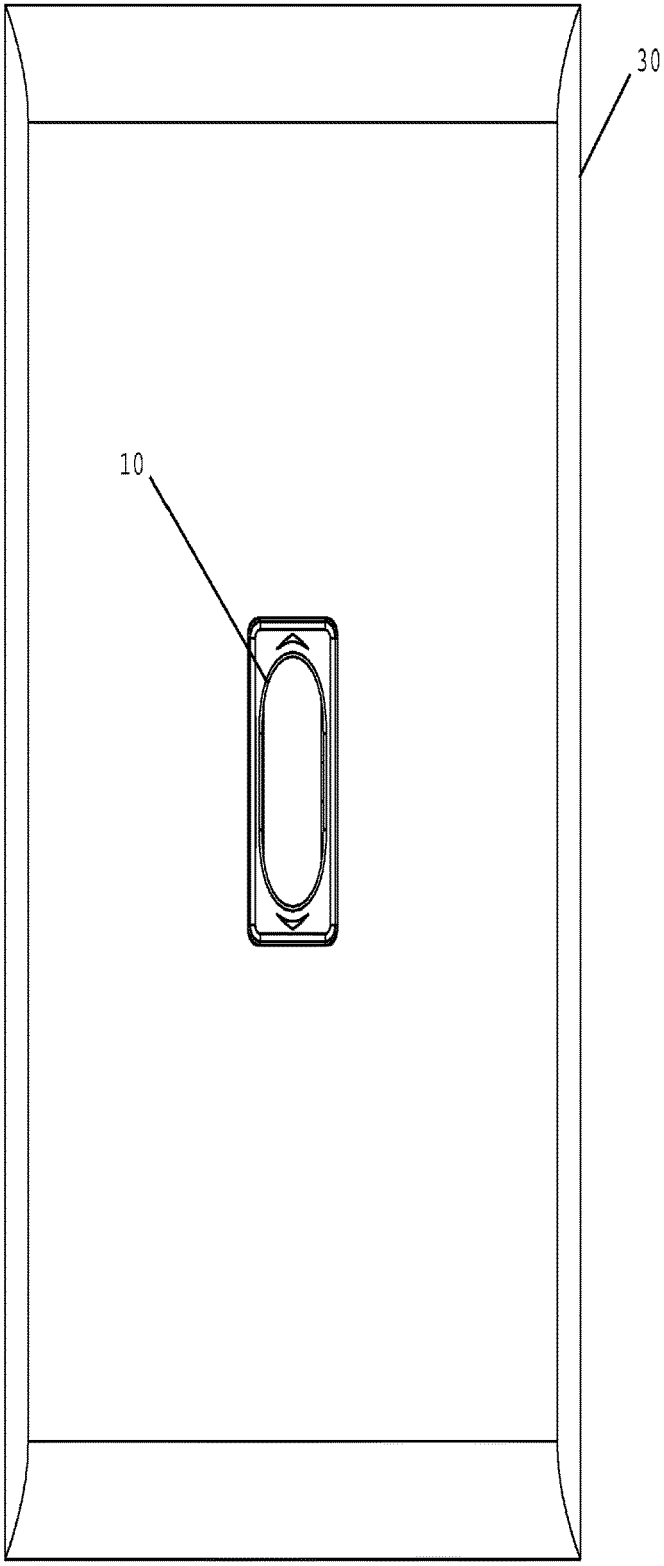
FIG. 2 shows the actuator of FIG. 1 mounted inside a wall box.
Figure 3:
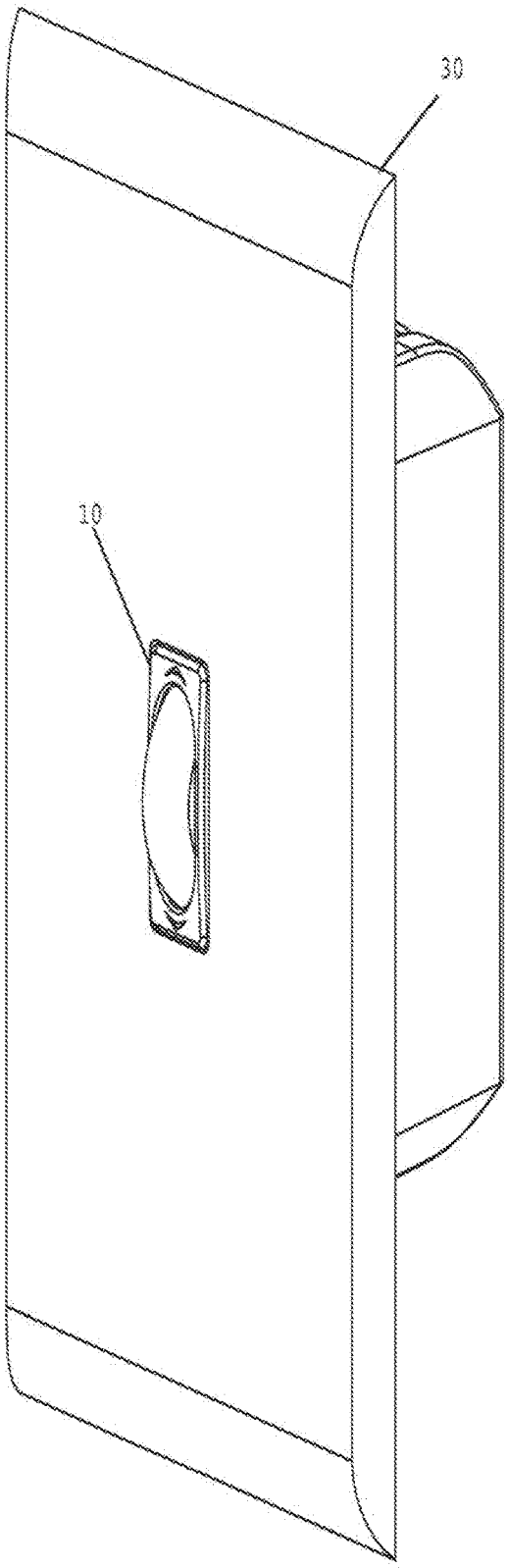
FIG. 3 is another view of the actuator of FIG. 1 mounted inside a wall box.
Figure 4:
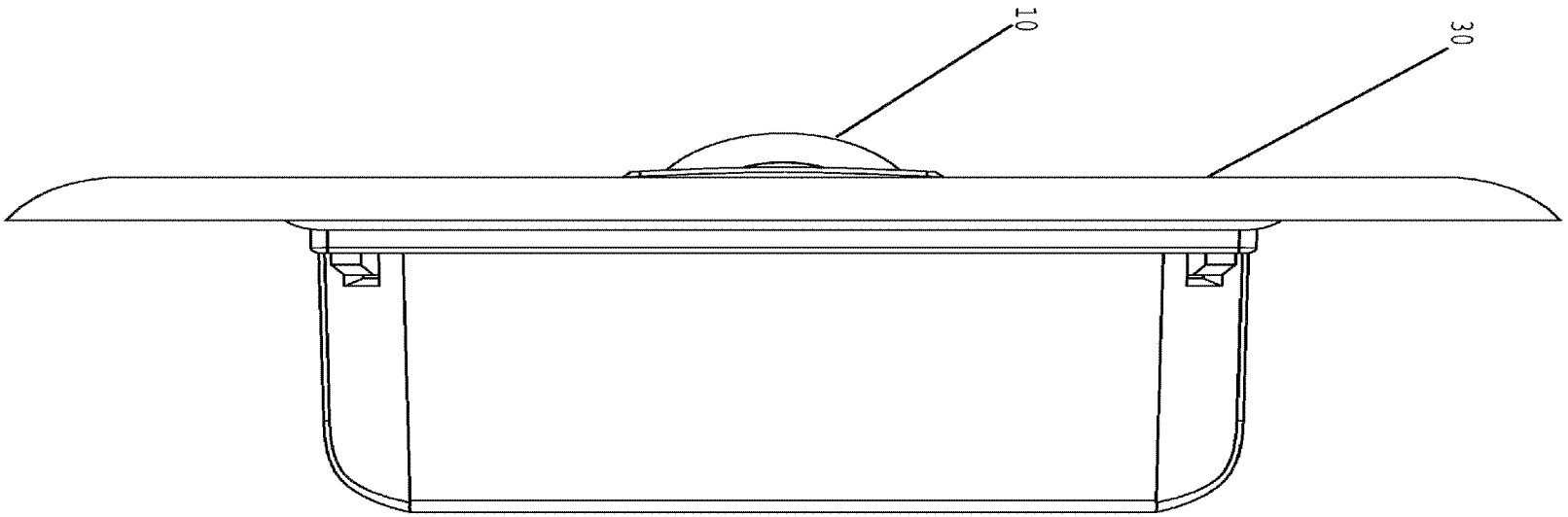
FIG. 4 is another view of the actuator of FIG. 1 mounted inside a wall box.

FIG. 2 is a front view of the dimmer switch. The wheel assembly 10 extends through the cover 30. FIG. 3 is a perspective view of the dimmer switch located, while FIG. 4 is a side view of the dimmer switch attached to a housing 50.

Figure 5:
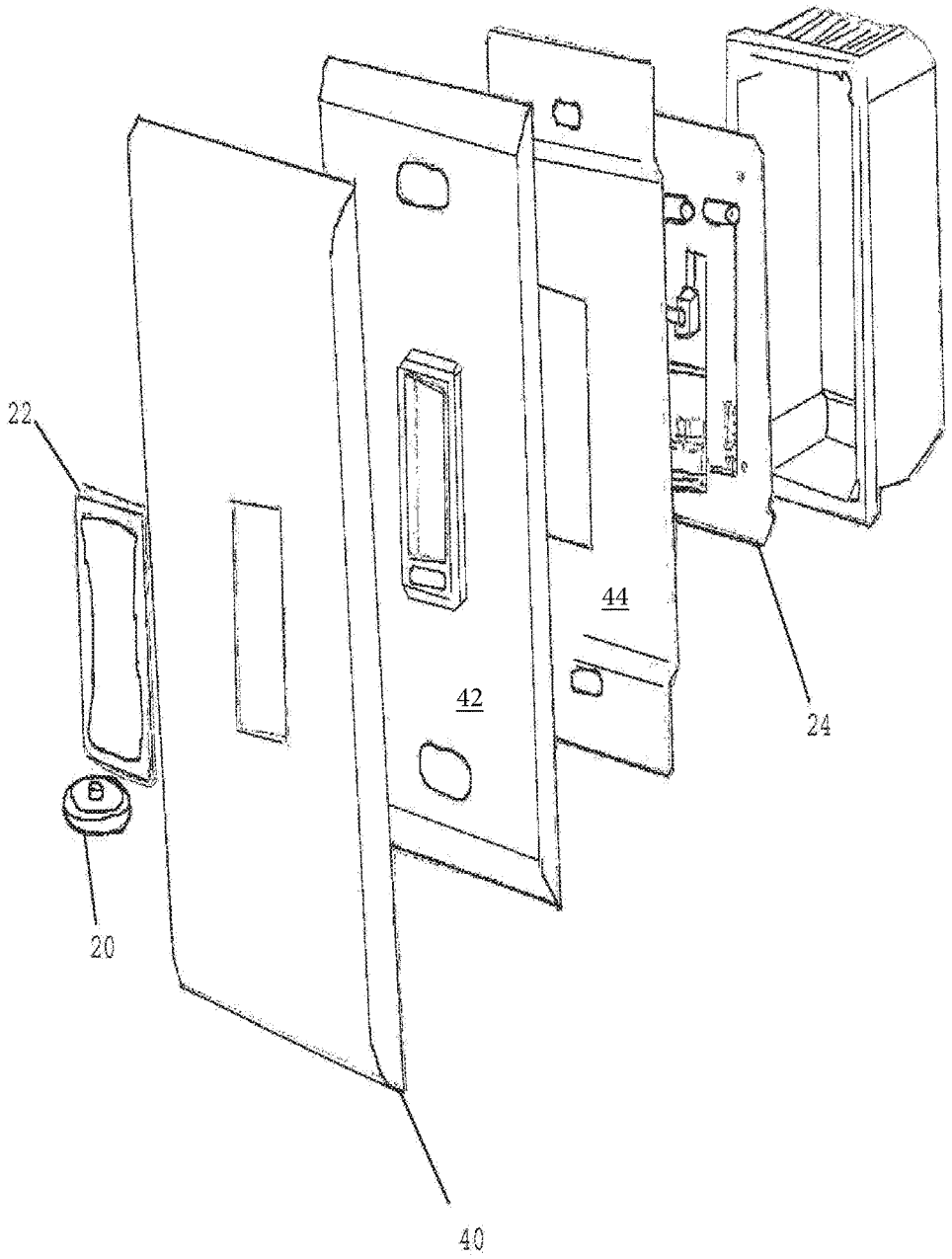
FIG. 5 shows an exploded view of a different embodiment of the dimmer switch.

FIG. 5 shows a different embodiment. Wheel 20 is mounted below toggle switch 22. Wheel 20 interacts with board 22 as previously described. Toggle switch 22 or push button could be used to turn the power on or off. Wheel 20 could also be depressed in order to access different functions of the dimmer. Circuit board 24 contains the processor and other electronics for the dimmer switch. Housing 50 is a light switch box which is used to contain and fasten the dimmer switch.

Wheel assembly 20 extends through cover 40. The axis of the wheel assembly 20 is vertical, and is also parallel to the cover 40. The wheel assembly 20 is shown below the toggle switch 22.

Cover plate 40 is positioned over secondary cover plate 42. Secondary cover plate 42 is positioned over board cover plate 44.

Figure 6:
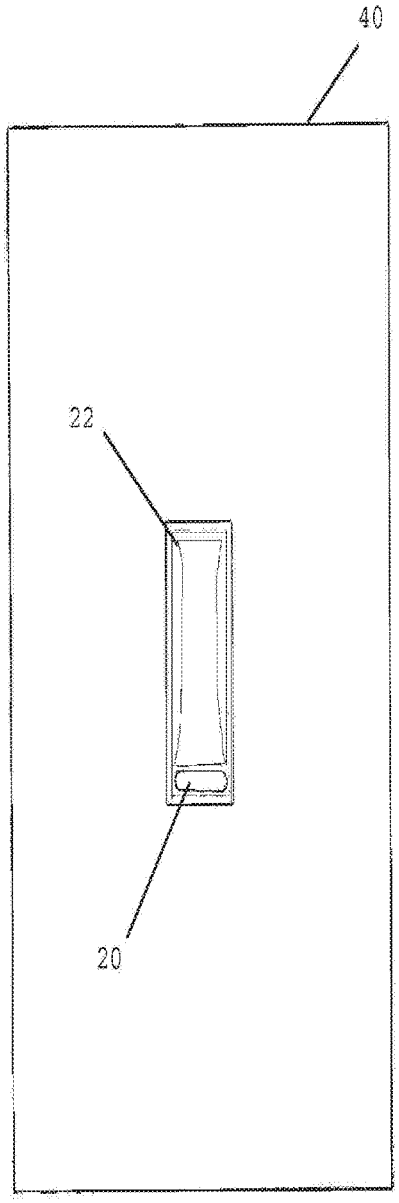
FIG. 6 shows a front view of the embodiment of the dimmer switch shown in FIG. 5
Figure 7:
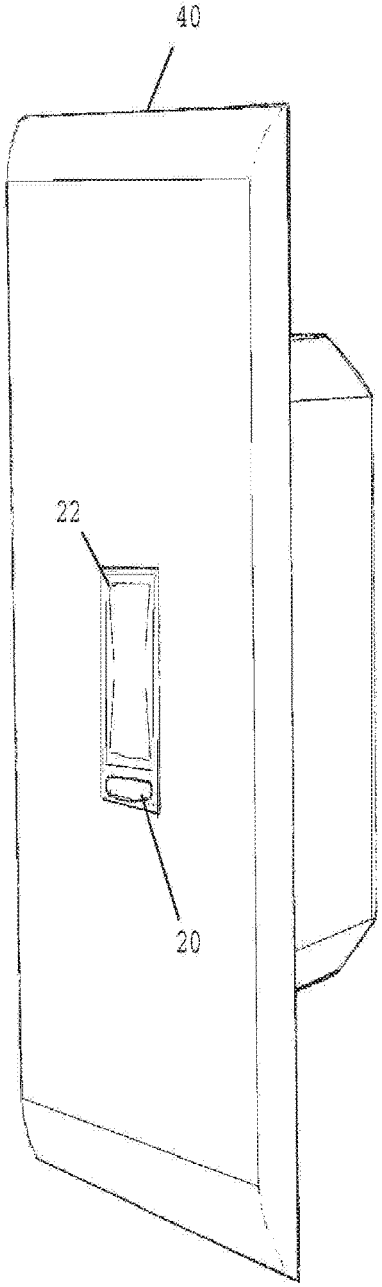
FIG. 7 shows a perspective view of the embodiment of the dimmer switch shown in FIG. 6.

FIG. 6 and FIG. 7 show the unit fully assembled of FIG. 5.

Figure 8:
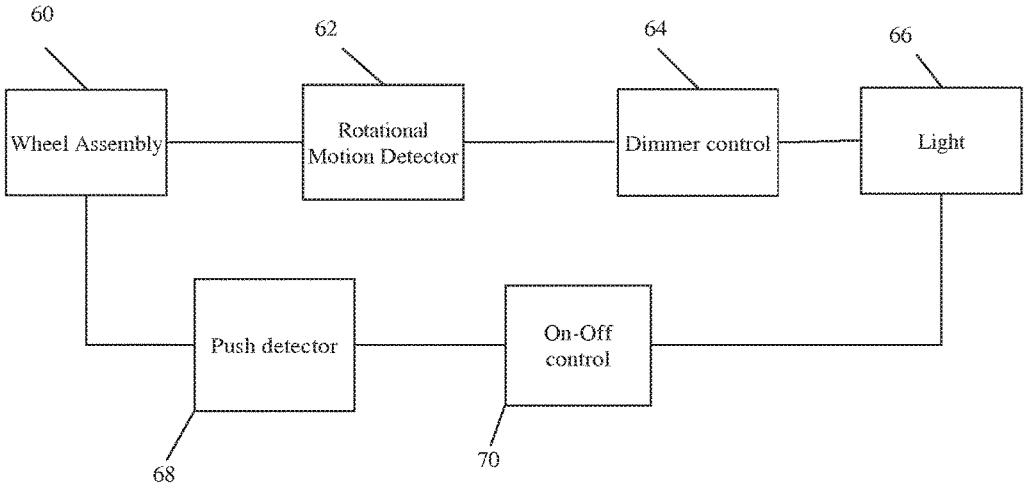
FIG. 8 shows a functional block diagram of the dimmer switch.

FIG. 8 shows a functional block diagram of the dimmer switch. The wheel assembly 60 is coupled to a rotational motion detector 62. The rotational motion detector 62 is coupled to a dimmer control 64, which, in turn, is connected to light 66. The rotational motion detector 62 could be, for example, a potentiometer. When the wheel assembly 60 is rotated, the rotational motion detector 62 causes dimmer control 64 to increase or decrease the energy provided to the 10 light 66, thereby increasing or decreasing the intensity of the light.

The dimmer control 64 could be one of many dimmer controls commonly used for changing the intensity of either incandescent or fluorescent light. For example, the dimmer control 64 could be a solid state dimmer for varying the duty cycle of the light. Alternatively, the dimmer control 64 could be a triac based dimmer.

The push detector 68 determines whether the wheel assembly 60 has been pushed. If the wheel assembly 60 has been pressed with sufficient force, the push detector 68 actuates the on/off control 70 to turn on or off the light 66.

The above description is of the preferred embodiment. Various alterations and changes can be made without departing from the spirit and broader aspects of the invention as 20 defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

We claim:

1. A mechanism for controlling a light comprising:

a wheel assembly having a rotational axis substantially perpendicular to a cover plate, the cover plate substantially parallel to a secondary cover plate and substantially parallel to a board cover plate, an outer circumference of said wheel assembly extending through the cover plate, secondary cover plate and board cover plate;

a rotational motion detector coupled to the wheel assembly for detecting a rotation of the wheel assembly, the rotational motion detector coupled to a circuit board that is substantially parallel to the board cover plate;

a dimmer control coupled to the rotational motion detector for increasing or decreasing a power output provided to the light, the dimmer control including a processor, the processor configured to increment or decrement a variable based upon a direction of rotation of the wheel assembly, the variable used to control the power output;

a push detector coupled to the wheel assembly for detecting whether the wheel assembly has been pushed; and an on/off control responsive to the push detector for controlling whether energy is provided to the light.

2. The mechanism of claim 1 where the rotation of the wheel assembly in a pre-selected direction increases the power output until it reaches a maximum, and further rotation of the wheel assembly in the pre-selected direction does not increase the power output.

3. The mechanism of claim 1 where rotation of the wheel assembly in a pre-selected direction increases the power output until it reaches a maximum, and further rotation of the wheel assembly in the pre-selected direction reduces the power output.

4. The mechanism of claim 1 where actuation of the push detector disables changes in the power output irrespective of rotation of the wheel assembly.

5. The mechanism of claim 1 where the rotational axis is coupled to the push detector such that movement of the axis is detected by the push detector.

6. The mechanism of claim 5 where the rotational motion detector includes a variable resistor with a resistance, the variable resistor connected to the rotational axis such that rotation of the axis changes the resistance.

7. A mechanism for controlling a light comprising:

a wheel assembly having a rotational axis substantially perpendicular to a cover plate, the cover plate substantially parallel to a secondary cover plate and substantially parallel to a board cover plate, an outer circumference of said wheel assembly extending through the cover plate, secondary cover plate and board cover plate;

a rotational motion detector coupled to the wheel assembly for detecting a rotation of the wheel assembly, the rotational motion detector coupled to a circuit board that is substantially parallel to the board cover plate;

a dimmer control coupled to the rotational motion detector, the dimmer control having a processor for controlling a power provided to the light; and a toggle switch.

* * * * *